United States Patent [19]

Heinrich

[11] 4,306,512

[45] Dec. 22, 1981

[54] HOMING TORPEDO SYSTEM

[75] Inventor: Morton O. Heinrich, Pasadena, Calif.

[73] Assignee: The United States of America as represented by the Secretary of the Navy, Washington, D.C.

[21] Appl. No.: 390,265

[22] Filed: Aug. 13, 1964

[51] Int. Cl.³ ..... F42B 19/01

[52] U.S. Cl. ..... 114/23

[58] Field of Search ..... 114/23, 20, 24, 25

[56] References Cited

U.S. PATENT DOCUMENTS

| | | | |
|---|---|---|---|
| 3,041,993 | 7/1962 | Robertson | 114/23 |
| 3,064,233 | 11/1962 | Gardiner et al. | 114/23 X |
| 3,215,109 | 11/1965 | Dunn | 114/23 |

*Primary Examiner*—David H. Brown

*Attorney, Agent, or Firm*—R. S. Sciascia; Ervin F. Johnston; P. H. Firsht

[57] ABSTRACT

In an echo-ranging homing torpedo having means for normally transmitting search pulses at a predetermined repetition rate, and having a receiver wherein detection of target echo signals, during listening intervals between search pulse transmission instants, is limited by the presence of reverberation signals, said receiver including a TVG amplifier followed by a signal amplitude-threshold type of detection circuit for discrimination of target echo signals from said reverberation signals, the gain-increase characteristic of said TVG amplifier normally being set to limit target-echo detection sensitivity to an extent preventing false-alarm response under the maximum reverberation conditions which may occur during target search action, in combination:

(a) means, responsive to initial detection of target echo signals, for switching said torpedo from a target search phase to a boresight homing phase of operation;

(b) means becoming effective, when target echo detection occurs within an echo return time of preselected value less than half of a normal listening interval determined by said normal search pulse repetition rate, for placing said torpedo in double-pulse operation;

and (c) means, responsive to double-pulse operation of said torpedo, for providing a modified gain-increase characteristic yielding increased target echo detection sensitivity.

3 Claims, 6 Drawing Figures

HOMING TORPEDO SYSTEM

The invention described herein may be manufactured and used by or for the Government of the United States of America for governmental purposes without the payment of any royalties thereon or therefor.

This invention relates generally to underwater object detection apparatus, and more particularly to such apparatus of active-acoustic type employing a pulse-echo ranging technique for determination of target presence, range and direction.

While principles of the invention may be utilized in various types of underwater object detection apparatus, the invention is of special utility and directly intended for use in anti-submarine acoustic homing torpedoes and will therefore be described, exemplarily, with reference to such application.

Anti-submarine acoustic-homing torpedoes are generally designed to be delivered by swim-out, airflight or other mode of transport to a suspect water region, then to operate in a target-search phase and, upon target detection, to effect switchover to a target-homing (pursuit and attack) phase in which the torpedo steers toward the target submarine in accordance with target direction information derived from received target signals; in the event of target signal loss during pursuit or as a result of target-miss during attack, the torpedo reverts to a target-search phase so that it may again effect target detection and pursuit. The target-sensing function is provided by means of so-called echo-ranging apparatus which repetitively transmits a search-pulse of ultrasonic energy, and which, in the listening intervals between search-pulse transmission instants, detects resultant target-echo signals provided such signals are present and of sufficient amplitude relative to background noise.

Transmission of search-pulses of acoustic energy in accordance with echo-ranging technique gives rise not only to target-echoes, as desired, but also to reverberation, the background noise component of particular concern relative to the torpedo performance-limiting problem solved by the present invention. Reverberation, considered in terms of its amplitude envelope during each listening interval, is of extremely high intensity immediately following each search-pulse transmission instant, decaying and falling below self-noise level at variable instants (relative to the search-pulse transmission instants) corresponding to ranges generally of the order of one-third nautical mile. Considering the reverberation signal as received in the various listening intervals during the course of a torpedo run, its initial intensity and its rate of decay vary considerably. Further, the term "reverberation" is here to be understood in its generalized sense rather than confined simply to so-called "volume-reverberation" (search-pulse energy reflection from myriad small scatterers distributed throughout the region of seawater); reverberation as here termed therefore encompasses noise signals and spurious pulse-echoes arising, for example, by reflection of search-pulse energy from the seawater surface, or bottom, or thermoclines (seawater layers or regions demarcated by comparatively large thermal gradients) or other discontinuities in the transmission medium. Thus, apart from exhibiting a generally decaying intensity in each listening interval, the reverberation amplitude envelope characteristic is extremely variable. Target echoes likewise are variable in amplitude, dependent upon a number of factors including target range, target direction relative to the transmit and receive field patterns, and effective reflection size of the target submarine, such size being dependent upon the particular type of target submarine and its aspect relative to the torpedo.

Modern torpedoes must operate to effect detection of target echoes in a manner to provide a satisfactory degree of freedom from so-called "false-alarm" response to background noise signals, since false-alarm response tends to decoy the torpedo from its target. Such operation with substantial freedom from false-alarm response, but heretofore generally with considerable reduction of target-echo detection sensitivity, is effected by use of a TVG (time-variable-gain) amplifier, in association with other amplifiers and with an amplitude-threshold type of echo-detection circuit, in the signal receiver section of the torpedo echo-ranging apparatus. In conventional practice, the TVG amplifier gain increases smoothly from a preselected minimum value (at the start of each listening interval) to a preselected maximum value (which latter value is then maintained to the end of the listening interval) in accordance with a predetermined and fixed time function, in such manner that the reverberation signal output of the TVG amplifier tends to be of substantially constant amplitude during any given listening interval, (except for spurious pulses and other amplitude variations as already indicated); the amplitude level of the reverberation signal output, however, is considerably different in various listening intervals because of the extremely variable amplitude characteristics of reverberation. The detection threshold can be set sufficiently high to make the echo-detection circuit unresponsive to the maximum expected amplitude of output background signal, correspondingly effecting detection of only those target-echo signals which are of sufficient amplitude to exceed the detection threshold; in actual practice, heretofore, the fixed TVG amplifier characteristic, the amplifier gains and the amplitude-threshold of the echo-detection circuit are set to such levels as to result in occasional response to spurious background signals (not exceeding a preselected "false-alarm rate" which can be tolerated), in order not to unduly limit target-echo detection sensitivity of the echo-ranging apparatus during the target search phase. However, the signal receiver section of the torpedo is nevertheless relatively insensitive even when the reverberation is low, since it remains set for protection against the highest expected reverberation level.

It will therefore be understood that while the foregoing arrangement including a conventional TVG amplifier system satisfies the requirement of detecting target echoes with substantial freedom from false-alarm response, this is accomplished at the expense of target-echo detection loss under certain pursuit phase conditions (since the receiver is constrained to be much less sensitive than it could be during periods of low-level reverberation), followed by reversion to a target-search phase (if a target-echo is not again detected within a so-called pursuit hold-over period generally of the order of a few listening intervals). It will also be understood that it is highly desirable to reduce the possibility of target-echo detection loss during target-pursuit, for the available run-time of a torpedo is rather limited and such loss followed by reversion to a further time-consuming search phase would greatly diminish the kill probability.

Target-echo detection loss during the pursuit phase, serious in the above-mentioned respect, has been found to be especially frequent in the case of torpedoes employing boresight type of homing (wherein the pursuit action progresses to a configuration in which the target is in substantially tail aspect and therefore presents small target size), and particularly when also employing an SLC (simultaneous lobe comparison) technique for target detection, resulting (during boresight homing action) in further reduction of target-echo amplitude. The SLC technique is here to be understood as involving transducer units or sections arranged and connected to provide, considering a single plane version, a single pair of directive reception lobes (field patterns indicating relative strength of signals as received from various directions), their axes being contained in say an azimuthal plane and diverging symmetrically relative to a forwardly directed central axis coincident with the torpedo axis; determination of target presence (and sense of target azimuthal direction relative to the torpedo axis) is effected by detection of the magnitude (and sense) of the amplitude difference of time-coincident echo-signals as received by dual azimuth channels in accordance with said divergent reception lobes, such detection being dependent upon reception of an echo-signal of sufficient amplitude to exceed the threshold set to reduce false-alarm response to an acceptable rate. Boresight homing is here to be understood as that type in which the torpedo tends to maintain its axis, and thus the central axis of its transducer unit, in alignment with the line-of-sight to the target.

The general object of the present invention is to provide an echo-ranging type of underwater object detection apparatus which increases its signal detection sensitivity, while retaining substantial freedom from false-alarm response, after reaching a target region characterized by reduced level of reverberation.

Another object of the invention is to provide an improved echo-ranging type of boresight homing torpedo which increases target-echo detection sensitivity during the terminal phase of homing action, to reduce the possibility of target-echo detection loss while retaining substantial freedom from false-alarm response.

A further object of the invention is to provide an echo-ranging type of boresight homing torpedo, employing an ALC technique for target detection, wherein greater target-echo detection sensitivity is employed during the terminal phase of homing action, while retaining substantial freedom from false alarm response, for the purpose of reducing the effective null pattern of the steering system about the torpedo axis.

Other objects and many of the attendant advantages of this invention will be appreciated as the same becomes better understood by reference to the following detailed description when considered in connection with the accompanying drawing wherein.

In accordance with the present invention as exemplarily embodied in an echo-ranging torpedo having boresight type of homing action and employing an SLC target-echo detection technique, the cyclic gain-increase characteristic of the TVG amplifier, normally set to constrain target-echo detection sensitivity to an extent dependent upon the maximum reverberation conditions which may occur during target search action, automatically becomes modified in a manner to yield increased target-echo detection sensitivity, provided that the torpedo is in a homing phase of operation and further has attained a condition wherein the torpedo has come within a preselected target range (corresponding to the condition wherein target-echo reception and detection occurs within a preselected target-echo return time measured from search-pulse transmission instants); such modified cyclic gain-increase characteristic is then retained during the remainder of the target homing phase of operation. Greater target-echo detection sensitivity can be employed without danger of false-alarm response, under the above-stated homing and target range conditions, basically for the reason that reverberation levels, under such conditions wherein the torpedo is closer to the target and in poorer attitude and more distant location relative to strong reverberation sources in the surrounding seawater region, are lower than during the search phase of operation.

Referring now to the torpedo system shown diagrammatically in FIG. 1, the invention being exemplarily embodied therein as will appear, each of the block-represented units may separately be of well-known type employing conventional circuitry; the modifying action to which the cyclic gain-characteristic of the TVG amplifier (forming part of the receiver unit) is subjected during the course of a torpedo run will be described in detail following the general description of the complete torpedo system, such description being necessary to an understanding of the disclosed embodiment of the invention.

Figures 1, 5:
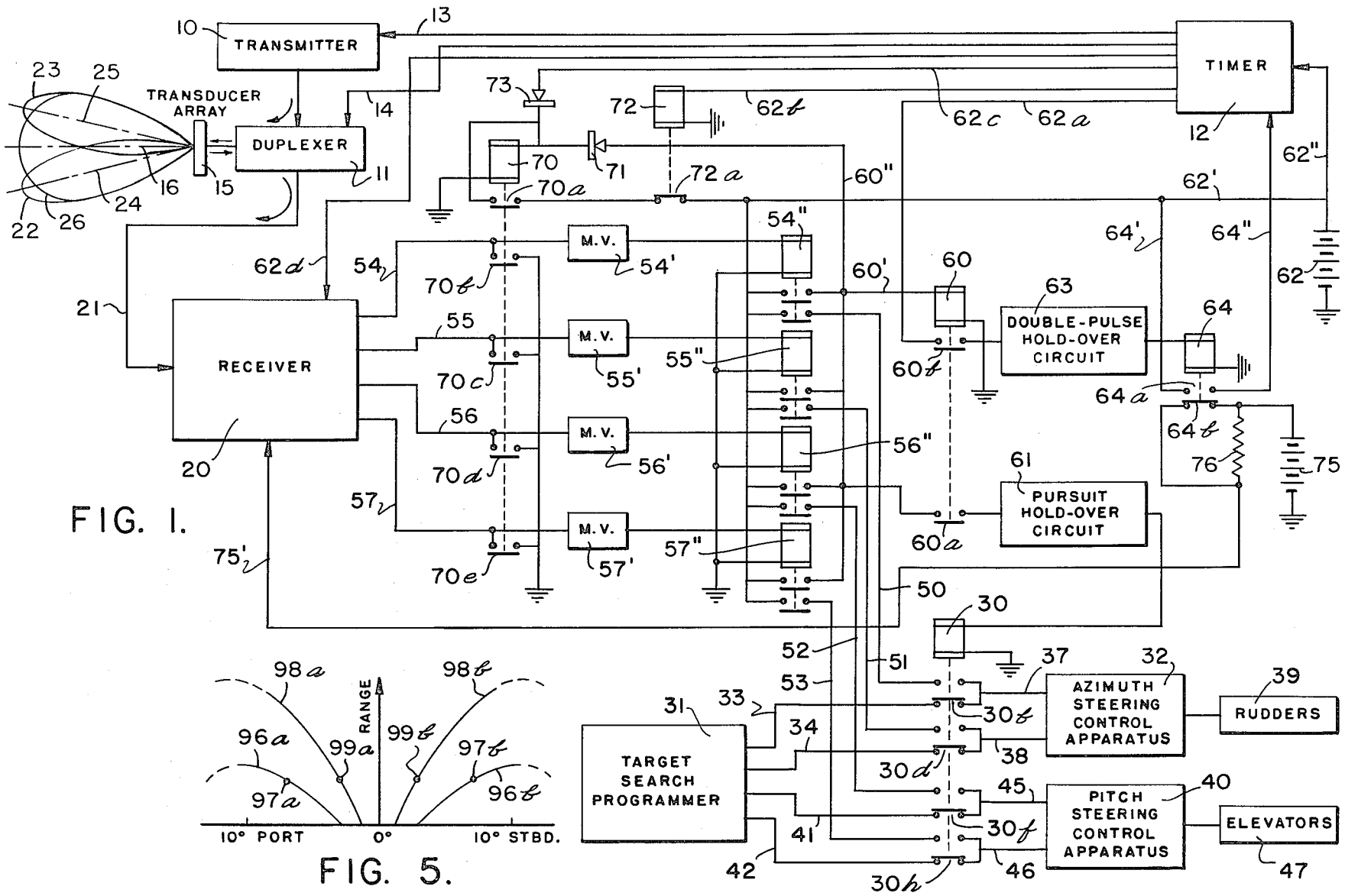
FIG. 1 is a schematic circuit, partly in block diagram form, of a complete torpedo system exemplarily embodying the invention.
FIG. 5 illustrates torpedo steering null patterns.

First considering therefore the organization and operation of the echo-ranging homing torpedo system illustrated in FIG. 1, transmitter 10 and duplexer 11 are controlled by timer 12 via leads 13 and 14, respectively, to cause repetitive excitation of transducer array 15 at suitable ultrasonic frequency for brief periods of say 2 ms (milliseconds) duration at intervals of say 1.25 seconds, resulting in the generation and underwater transmission of search pulses having like frequency, duration and interval characteristics. Transducer array 15 is to be understood as mounted in the nose section of the torpedo body (not shown) in accordance with conventional practice. Duplexer 11 enables employment of the transducer array 15 both for transmission of search pulses and for reception of resultant target-echo signals. For use with associated receiver circuits which, by SLC technique, effect determination of target direction in azimuth relative to the forwardly directed central axis 16, transducer array 15 comprises sections (not shown) which, during the listening intervals, are connected by duplexer 11 to receiver 20 via cable 21 to provide dual azimuth channels fed in accordance with port and starboard receiving field patterns 22 and 23 extending along receiving axes 24 and 25, respectively, lying in an azimuthal plane which also contains the central axis 16.

Target direction in depth may be determined by receiver 20 in like manner or by phase comparison technique, in accordance with conventional practice. During the brief period of transmission, the transducer sections are connected by duplexer 11 in a manner to yield a single transmission beam or field pattern 26 extending directly along the central axis 16.

During the target search phase and prior to reception of target-echo signals, pursuit relay 30 is in de-energized condition and torpedo steering is correspondingly under full control of target search programmer 31 which may be of any conventional type, for example of a type functioning to control the torpedo to first execute a so-called runout and snake search pattern, followed by a helical search pattern in which the torpedo circles while ascending and descending between preselected ceiling and floor depths; port and starboard turn command signals are transmitted to azimuth steering control apparatus 32 via leads 33, 34 through relay 30 switches 30*b*, 30*d* and leads 37, 38, respectively, resulting in steering control of rudder 39; climb and dive command signals are transmitted to pitch steering control apparatus 40 via leads 41, 42 through relay 30 switches 30*f*, 30*h* and leads 45, 46, respectively, resulting in steering control of elevator 47.

Upon first detection of a target echo, the torpedo enters a homing phase: pursuit relay 30 becomes energized, transferring control of the azimuth and pitch steering control apparatus 32 and 40, respectively, to the steering command signals derived by the receiver and associated equipment and presented at leads 50, 51, 52 and 53. Following continued homing action and upon reception of an echo from the target within a preselected range of say 1250 feet (corresponding to echo reception within 0.5 seconds measured from search-pulse transmission instants), the torpedo enters a double-pulsing condition in which search-pulses are transmitted at twice normal rate, the listening interval is correspondingly halved, and the cyclic gain-increase characteristic of the TVG amplifier is modified to yield increased target-echo detection sensitivity as mentioned earlier. A holdover function is provided for retaining the torpedo in homing condition for several listening intervals after reception of each target echo and consequently for such period after loss of target echo, rather than to immediately revert to a time-consuming search phase; such retention of homing condition after target echo loss, termed pursuit holdover, causes the torpedo to continue in the general direction of the last detected target location and presents high probability of quickly regaining target echoes after transient loss. Blanking functions are provided for rendering the torpedo unresponsive to spurious echo or noise signals received during the same listening interval from sources at greater range than that from which a target echo has just been received; and from sources at ranges greater than say about 1400 feet, for some preselected holdover period following loss of echo from a target within that range, provided the torpedo is in double-pulsing condition as a result of having already received an echo from a target within a preselected range of say 1250 feet.

Considering the organization and operation of the echo-ranging homing torpedo system in somewhat greater detail, transducer array 15 and receiver 20 operate in such manner that reception of a sufficiently strong echo results in say a negative pulse at either lead 54 or 55 and at either lead 56 or 57, dependent upon whether the echo arrives from a target to port or to starboard, and up or down, relative to central axis 16. These pulses are of comparatively short duration and are applied to multivibrators 54' to 57' which are designed to be triggered by the negative pulses and to operate effectively as pulse stretchers which provide so-called trip relays 54'' to 57'' with sufficiently long current pulses of say about 30 ms duration. The resultant energization of any one of these trip relays 54'' to 57'' causes momentary energization of holdover-circuit-triggering relay 60; energization of the latter relay takes place via source 62, lead 62', any closed upper switch of trip relays 54'' to 57'' and lead 60' connecting to all of the right-hand contacts of relay 54'' to 57'' upper switches; the resultant brief closure of switch 60*a* of relay 60 places or continues pursuit-holdover circuit 61 in operation by applying a positive voltage pulse thereto from source 62 through the closed upper switch of any trip relay 54'' to 57''; the simultaneous brief closure of switch 60*b* of relay 60 places or continues double-pulse holdover circuit 63 in operation by applying a positive voltage pulse thereto from source 62 via lead 62'' and timer lead 62*a* provided a preselected target range condition is met as later described. Pursuit-holdover circuit 61, whenever triggered, maintains pursuit relay 30 in closed condition for say several full listening intervals. Double-pulse holdover circuit 63, whenever triggered, maintains double-pulse relay 64 in closed condition for say several double-pulse listening intervals.

In addition to causing energization of holdover-circuit-triggering relay 60 and ensuing operation of other circuits as already described, operation of any of the trip relays 54'' to 57'' (as a result of target echo reception) also results in energization of blanking relay 70, by application of a positive pulse thereto from source 62, lead 62', any closed trip relay upper switch, lead 60'' and diode 71; blanking relay 70 then remains closed (until just after the next search-pulse) because of the hold-in action provided by voltage applied through its closed switch 70*a* from source 62 through lead 62' and normally closed switch 72*a* of reset relay 72. Since energization of blanking relay 70, in this instance as a result of and following receipt of a target echo, closes its switches 70*b*, 70*c*, 70*d* and 70*e*, and grounds any multivibrator triggering pulses tending to be developed at leads 54, 55, 56 or 57 as a result of later-occurring spurious echoes, the torpedo steering control system is protected against false-steering commands which would arise from such later-occurring spurious echoes. Such blanking condition is hereinafter termed "trip-blanking" to distinguish it from a later-described "double-pulse range blanking" condition. The trip-blanking condition occurs only in response to target-echo reception and is maintained only until just after transmission of the next search pulse, at which time reset relay 72 is energized via lead 62*b* by timer 12, switch 72*a* opens and breaks the hold-in circuit of blanking relay 70, blanking relay 70 accordingly becomes de-energized and all of its switches open, readying the system for response to the next received target echo.

The previously-mentioned double-pulse range blanking function prevents the torpedo, after having entered a double-pulsing phase of operation as a result of having received an echo from a target within a preselected range of say 1250 feet, from responding to signals from sources at ranges greater than a preselected minimum of say about 1400 feet (even following loss of echo from a target), during the holdover period set by double-pulse holdover circuit 63. Lead 62*a* connecting from timer 12 to the left-hand contact of switch 60*b* carries a positive voltage only during the first 0.5 seconds of each listening interval. Thus, when echo reception arises from a target which has been approached within the corresponding range of 1250 feet and holdover-circuit-triggering relay 60 correspondingly closes its switch 60*b* within the first 0.5 seconds of the listening interval, double-pulse holdover circuit 63 is triggered, energizing double-pulse relay 64 and continuing its energization during the preselected double-pulse holdover period; a positive voltage is therefore applied from source 62, through leads 62' and 64', through closed switch 64*a* and lead 64'' to timer 12, wherein a timer disc causes that positive voltage to momentarily appear at lead 62*c* and to be applied through diode 73 to blanking relay 70; at a listening interval instant corresponding to a range of 1400 feet, blanking relay 70 thus becomes energized, and remains energized by action of the hold-in circuit until the next search pulse, protecting the torpedo steering control system against false steering commands which would arise from later-occurring spurious signals, as already described in connection with the trip-blanking function.

Figure 2:
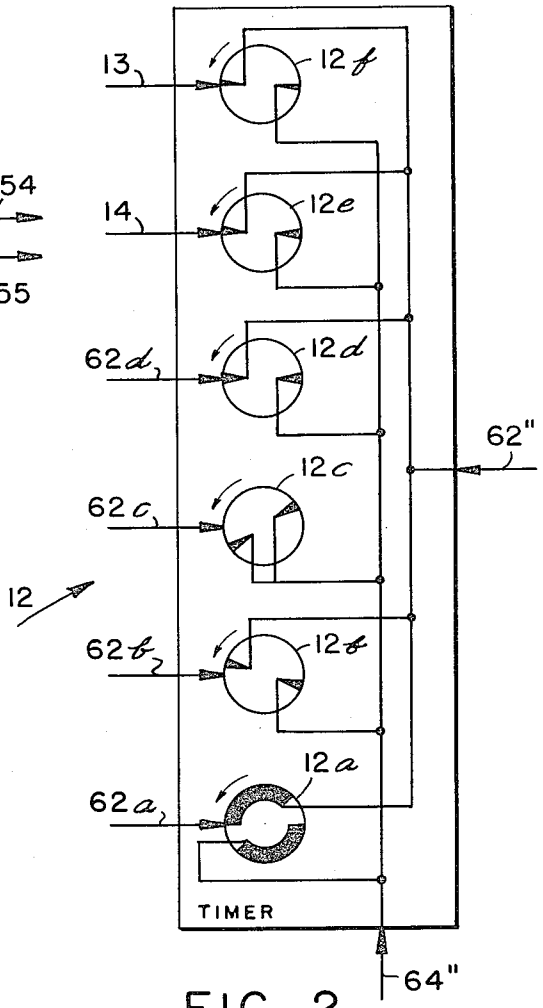
FIG. 2 is a diagrammatic representation of timer elements of interest with reference to certain timing functions provided in the FIG. 1 torpedo system.

At this point briefly referring to FIG. 2 for a better understanding of the manner in which timed pulses as described are supplied by the timer 12 which is shown simply in block form in FIG. 1, timer 12 may be of entirely conventional type as to general structure, for example employing timing discs 12*a* to 12*f*, mounted on a common shaft driven by electrical motor means (not shown), say in a counter-clockwise direction as seen in FIG. 2, at a rate setting the selected search pulse repetition rate, namely at one revolution per 1.25 seconds in this instance. The timing discs 12*a* to 12*f* are provided with a pair of conductive segments, here indicated as darkened portions of the discs, to which voltages are supplied via leads 62'' and 64'', through brushes and slip rings (not shown) here indicated schematically simply by direct connection of the leads to the conductive segments. Similarly, the leads leaving timer 12 from the left are to be understood as extending from line-contact brushes, here indicated simply as arrow heads, for making sliding contact against the conductive segments during rotation of the discs 12*a* to 12*f*. The two segments of each disc are alike and positioned 180 degrees apart. One of each pair of segments is continuously supplied with voltage from source 62 (FIG. 1) via lead 62'', and the remaining segments receive voltage from the same source 62, via lead 64'', when the torpedo is in double-pulse operation, under which condition timer 12 causes all timed functions to take place at twice normal rate.

In the disclosed torpedo system embodying the present invention, referring again to FIG. 1, double-pulse holdover circuit 63 functions not only to effect double-pulsing action, double-pulse holdover action and double-pulse range-blanking action as described, but further, when it comes into operation, modifies circuitry associated with the TVG amplifier, in such manner as to provide increased target-echo detection sensitivity. It should be noted at this point that the term "TVG amplifier" as used in this application refers collectively to the several TVG amplifier units employed as the first stage in each of the several receiver signal channels. Each channel of the TVG amplifier forming part of receiver unit 20 includes a variable-gain control RC circuit, next shown and described more fully, which is cyclically charged from source 75 via lead 75', under control of relay means (later shown) energized via timer lead 62*d* during search pulse generation. For convenience of illustration and description, source 75, the normally shunted voltage-reducing resistor 76, and lead 75', associated with both the TVG amplifier gain-control circuits and double-pulse relay 64, are here shown in proximity to double-pulse relay 64. During the target search and homing phases, and until the double-pulse condition is entered, double-pulse relay 64 is not energized, the voltage-reducing resistor 76 is shorted out, the full voltage of source 75 therefore appears at lead 75', and the cyclic gain-increase characteristic of the TVG amplifier is normal in that it constrains target-echo detection sensitivity to an extent dependent upon the maximum reverberation conditions which may be encountered. When an echo is received from a target which has been approached to within the previously-mentioned preselected distance of 1250 feet, double pulse relay 64 is energized as described, switch 64*b* opens, thus inserting voltage-reducing resistor 76 between source 75 and lead 75', and modifying the cyclic gain-increase characteristic of the TVG amplifier in a manner to increase target-echo detection sensitivity as will next appear and for reasons as already given.

Figure 3:
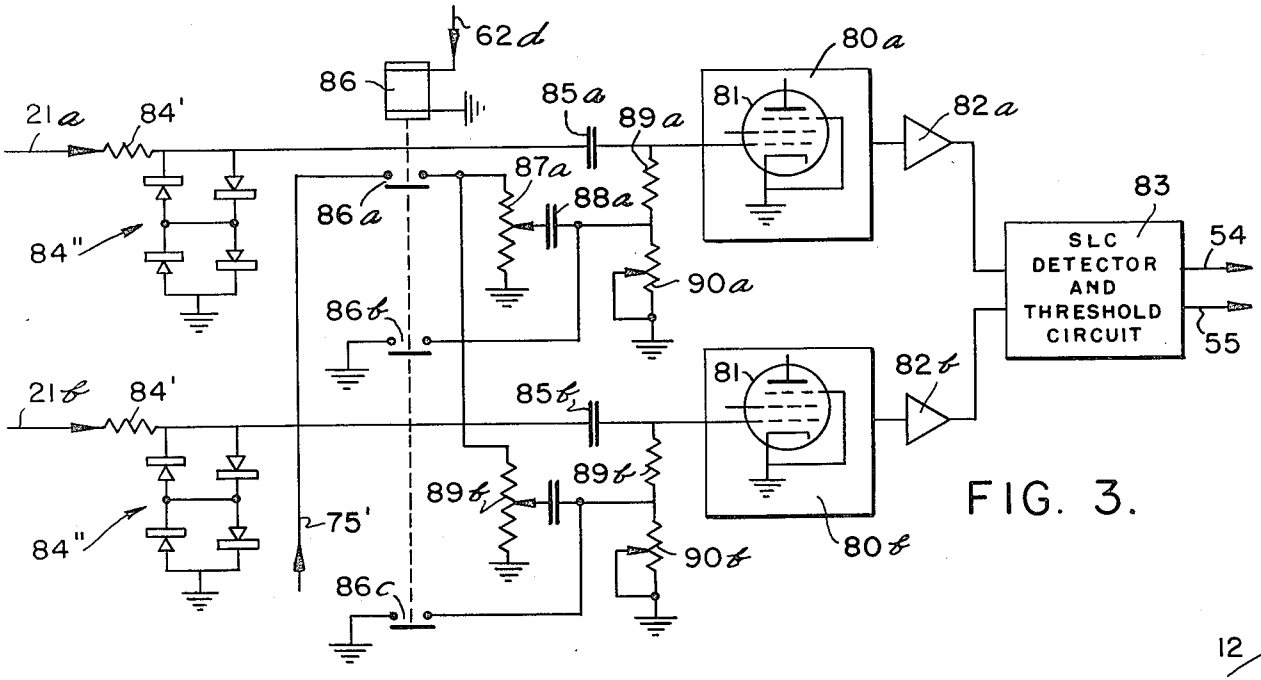
FIG. 3 is a schematic circuit basically concerning the TVG amplifier forming part of the receiver unit shown in FIG. 1.

A homing torpedo system as described may ordinarily employ TVG amplifier units in both the azimuth and elevation signal channels of the receiver. Sufficing for an understanding of the manner in which the variable-gain control RC circuits operate in association with the TVG amplifier units in each of the signal receiver channels, FIG. 3 illustrates the previously-mentiond dual azimuth channels to which signals are supplied from transducer array 15 via duplexer 11 (FIG. 1) and input leads 21*a* and 21*b*, at amplitudes as received in accordance with the divergent reception lobes 22 and 23 (FIG. 1). Except for their variable-gain control RC circuits which are shown in detail, the remaining circuitry of the TVG amplifier units may be entirely conventional and are therefore illustrated simply in block form at 80*a* and 80*b*, each employing a variable-mu pentode tube 81 of so-called sharp-cutoff type, commercial type 6BA6 by way of example. Further amplifiers as necessary are provided as indicated at 82*a* and 82*b*, followed by an SLC detector and threshold circuit 83 which may be of conventional type, delivering its output pulses to leads 54 and 55 as already described. The voltage-divider arrangement comprising, in each of the dual azimuth channels, the resistor 84' and the multiple-diode circuit 84'', functions to protect the receiver input components (including the tubes 81) from the intense surge voltages produced at the instants of search pulse generation and transmission; the diodes as employed in circuit 84'' have the characteristic of normally exhibiting high resistance at ordinary-level input signals but present very low resistance at high input voltage levels, and for such purpose are preferably of the commercial type IN461; the values of resistors 84' are typically about 4500 ohms. Input signals are applied to the control grids of tubes 81 of TVG amplifier units 80*a*, 80*b* through coupling capacitors 85*a* and 85*b*, respectively, which may be of about 400 picofarad value. Relay 86 becomes energized via lead 62*d* from timer 12 (FIG. 1) several milliseconds before generation of a search-pulse, remaining energized until a few milliseconds after search-pulse termination; during such relay energization period, closed relay switch 86*a* completes the circuit from lead 75' (extending from source 75 through shorted or unshorted resistor 76, FIG. 1) to potentiometers 87*a* and 87*b*, and closed relay switches 86*b* and 86*c* ground the right-hand plates of so-called TVG capacitors 88*a* and 88*b* of the dual azimuth channels, causing the TVG capacitors 88*a* and 88*b* to become fully charged to whatever DC voltage has been present at the arms of potentiometer 87*a* and 87*b*, dependent upon the settings of potentiometers 87*a* and 87*b* and upon whether voltage-reducing resistor 76 is in circuit as a result of the torpedo being in double-pulse operation. Upon de-energization of relay 86 and opening of its switches 86*a*, 86*b* and 86*c*, the voltage at the right-hand plate of capacitor 88*a* (and of capacitor 88*b*), and correspondingly at the junction point of resistor 89*a* and adjustable resistor 90*a* (and of resistor 89*b* and adjustable resistor 90*b*), is negative relative to ground, thus initially placing tube 81*a* (and tube 81*b*) in an initially high-bias, low-gain condition at the start of the listening interval; because of ensuing capacitor discharge, the bias decreases (and the gain of the amplifier stages 80*a* and 80*b* correspondingly increase) during the listening interval, yielding the previously-mentioned TVG characteristic which maintains the reverberation output signal at substantially constant level during any given listening interval as has been described.

It will now be understood, referring to FIGS. 1 and 3 and in view of the foregoing description, that during the target search and homing phases, and until the double-pulse condition is entered, voltage-reducing resistor 75 is shorted out and the cyclic gain-increase characteristic of the TVG amplifier is correspondingly normal; and that when an echo is received from a target which has been approached to within the preselected distance of 1250 feet, switch 64*b* opens and thus inserts voltage-reducing resistor 76 in series with the upper portions of potentiometers 87*a* and 87*b*, reducing the charging voltage applied to the TVG capacitors 88*a* and 88*b*, respectively, and correspondingly modifying the TVG characteristic in a manner to increase target-echo detection sensitivity. The initial negative bias and correspondingly the initial TVG amplifier gain is a function of the source 75 voltage and of the setting of potentiometer 87*a* (and 87*b*); the initial negative bias and initial TVG amplifier gain under double-pulse condition is additionally a function of the ohmic values of voltage-reducing resistor 76 and of the paralleled potentiometers 87*a* and 87*b*; the rate of discharge of TVG capacitors 88*a* and 88*b* is dependent principally upon the setting of adjustable resistors 90*a* and 90*b*. In a typical embodiment, wherein the peak search-pulse power as supplied by transmitter 10 (FIG. 1) may be of the order of 2000 watts, suitable values and settings of the several components of the RC variable-gain control circuit are as follows:

| | |
|---|---|
| Source 75 | 225 volts |
| Capacitors 88a, 88b | 0.33 microfarad |
| Resistor 76 | 13,000 ohms |
| Resistors 89a, 89b | 0.5 megohm |
| Potentiometers 87a, 87b | 75,000 ohms, arm set at about 15,000 ohms above ground |
| Resistors 90a, 90b | 1.0 megohm, set at about 670 kilohms |

Figure 4A:
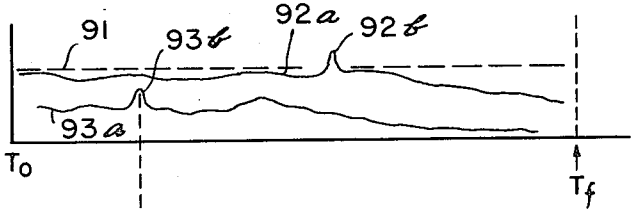
FIG. 4A illustrates TVG amplifier output reverberation and target-echo amplitudes, relative to a detection threshold level, under search and pursuit conditions.
Figure 4B:
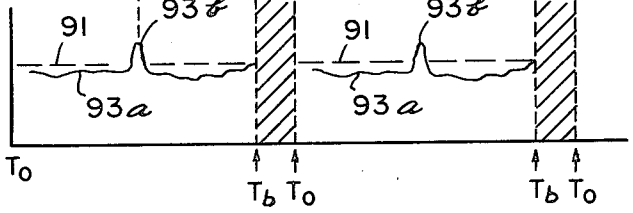
FIG. 4B illustrates the improved target-echo detection condition obtained by use of the present invention.

FIGS. 4A and 4B, drawn to the same time scale and having like detection threshold levels 91, illustrate the type of improvement afforded by the present invention as to yielding increased target-echo detection sensitivity during the terminal phase of pursuit, while retaining freedom from false-alarm response. FIG. 4A represents at 92*a* the near-maximum output reverberation-signal level (which may be encountered during the target search phase of operation), relative to the detection threshold level 91, employing a full listening interval ($T_o$ to $T_f$) and normal settings of the TVG amplifier and associated circuits, resulting in detection of a target echo provided it is of sufficient amplitude as at 92*b*; in ordinary practice in accordance with conventional techniques, however, even when the boresight-homing torpedo has pursued the target to a water region wherein the reverberation level is generally lower as at 93*a*, a poor-aspect target yields an echo 93*b* of insufficient amplitude to be detected (particularly in the case of torpedoes employing an SLC target-detection technique) because the TVG amplifier characteristic remains the same during the entire torpedo run. The improvement afforded by the present invention is illustrated in FIG. 4B wherein, after an echo is received from a target which has been approached to within the preselected distance of 1250 feet in this instance, the cyclic gain-increase characteristic of the TVG amplifier is modified to yield increased target-echo detection sensitivity during listening intervals extending from search-pulse transmission instants $T_o$ to double-pulse range-blanking instants $T_b$, now resulting in amplifying the target-echo 93*b* to sufficient intensity for detection.

It will be understood that where divergent reception lobes and an SLC technique of target detection are employed, as in the described homing torpedo system embodying the present invention, target-echoes as received by the transducer array field patterns, when the torpedo axis is in substantial alignment with the line-of-sight to the target, will not be of sufficient differential amplitude to yield steering command signals, resulting in torpedo steering response patterns exhibiting a null region as shown in FIG. 5; FIG. 5 concerns steering response of a torpedo as described operating at comparatively close ranges (say up to 1400 feet) against a poor-aspect target (say a "5 DB" target as termed in the art). The curves at 96*a* and 96*b* illustrate the usual steering response characteristic resulting from employment of a normal TVG characteristic throughout the entire torpedo run in accordance with the prior art. By way of interpretation and example, steering response will not take place against the target until it is in relative direction and range to meet the port or starboard steering response curves 96*a* or 96*b*, respectively, say at a point 97*a* or 97*b*, respectively, or to come below these curves; thus, at a target range corresponding to that defined by a line joining points 97*a* and 97*b*, steering response cannot take place unless the target direction relative to the torpedo axis is greater than about 7 degrees to port or to starboard, a rather wide null region. The curves at 98*a* and 98*b* illustrate the improved torpedo steering response pattern found to result from employment of the present invention; for example at the same target range as represented by the points 99*a* and 99*b*, respectively, the null region is significantly narrower, of the order of 3 degrees to port and to starboard. The importance of the foregoing concerns the turn rates of which the torpedo must be capable to continue in attack against the target, and in conjunction with decreased target-echo detection sensitivity further concerns the kill probability. Prior art boresight homing torpedoes, employing a SLC technique of target detection, require inordinately high turn rates when operating against a high-speed target, and are especially prone to abort when operating against a poor-aspect or small-size target. Use of the present invention has been found to overcome these severe problems.

Obviously many modifications, variations and applications of the invention are possible in the light of the above teachings. It is therefore to be understood that, within the scope of the appended claims, the invention may be practiced otherwise than as specifically described herein.

I claim:

1. In an echo-ranging homing torpedo having means for normally transmitting search pulses at a predetermined repetition rate, and having a receiver wherein detection of target echo signals, during listening intervals between search pulse transmission instants, is limited by the presence of reverberation signals, said receiver including a TVG amplifier followed by a signal amplitude-threshold type of detection circuit for discrimination of target echo signals from said reverberation signals, the gain-increase characteristic of said TVG amplifier normally being set to limit target-echo detection sensitivity to an extent preventing false-alarm response under the maximum reverberation conditions which may occur during target search action, in combination:

(a) means, responsive to initial detection of target echo signals, for switching said torpedo from a target search phase to a boresight homing phase of operation;

(b) means becoming effective, when target echo detection occurs within an echo return time of preselected value less than half of a normal listening interval determined by said normal search pulse repetition rate, for placing said torpedo in double-pulse operation;

and (c) means, responsive to double-pulse operation of said torpedo, for providing a modified gain-increase characteristic yielding increased target echo detection sensitivity.

2. Apparatus as defined in claim 1, including:

(d) holdover means for retaining said torpedo in a homing phase of operation, rather than immediately reverting to a search phase of operation, for a preselected time of the order of several listening intervals following loss of target echo detection.

3. Apparatus as defined in claim 2, including:

(e) means responsive to double-pulse operation of said torpedo for preventing response to signals received beyond a predetermined time following search pulse transmission instants.

* * * * *